US005755496A

United States Patent [19]

Hahn

[11] Patent Number: 5,755,496

[45] Date of Patent: May 26, 1998

[54] CABINET FOR DISPLAYING OBJECTS

[75] Inventor: Thomas Hahn, Frankfurt am Main, Germany

[73] Assignee: Glasbau Hahn GmbH & Co. KG, Germany

[21] Appl. No.: 755,973

[22] Filed: Nov. 25, 1996

[30] Foreign Application Priority Data

Nov. 23, 1995 [DE] Germany ..... 195 43 616.4

[51] Int. Cl.[6] ..... A47F 3/00

[52] U.S. Cl. ..... 312/139; 312/319.5; 312/328

[58] Field of Search ..... 49/333, 334, 337, 49/338; 312/138.1, 139, 114, 117, 319.5, 319.6, 319.7, 319.8, 327, 328

[56] References Cited

U.S. PATENT DOCUMENTS

| | | | |
|---|---|---|---|
| 3,359,050 | 12/1967 | Dongus | 312/327 X |
| 3,716,281 | 2/1973 | Rudder, Jr. | 312/114 |
| 4,638,597 | 1/1987 | Lybecker | 49/340 |
| 4,844,567 | 7/1989 | Chalabian | 312/139 |
| 5,116,274 | 5/1992 | Artwohl et al. | 312/139 X |
| 5,558,416 | 9/1996 | Dumitru | 312/138.1 X |

FOREIGN PATENT DOCUMENTS

| | | | |
|---|---|---|---|
| 524437 | 12/1953 | Belgium | 312/114 |
| 0 301 960 | 2/1989 | European Pat. Off. . | |
| 0 416 340 | 3/1991 | European Pat. Off. . | |
| 440937 | 8/1991 | European Pat. Off. | 49/337 |
| 0 590 278 | 4/1994 | European Pat. Off. . | |
| 0 670 405 | 9/1995 | European Pat. Off. . | |
| 4 403 973 | 8/1995 | Germany . | |

*Primary Examiner*—Jose V. Chen
*Assistant Examiner*—Janet M. Wilkens
*Attorney, Agent, or Firm*—Haynes and Boone, L.L.P.

[57] ABSTRACT

A cabinet for displaying objects comprises a top part (1) resting on an under part and which consists of a top face, a rear side (3), left (4) and right (6) sides, a bottom face (10) and a front side (5) consisting of a glass sheet (25) pivotally fitted on the top face (9) to swing upwardly. The glass sheet (25) is surrounded by a frame (11) on all sides. In the region of the front side (5) a gas spring (13) is rotatably attached to the bottom face (10) in the region of each of the left (4) and right (6) sides and acts in the region of the middle of the frame (11). The pivoting movement of the front side (5) is effected by screw jacks (14) acting above each of the gas springs (13) and driven by electric motors. Synchronous operation of the two electric motors is ensured by an electronic control device.

13 Claims, 3 Drawing Sheets

CABINET FOR DISPLAYING OBJECTS

BACKGROUND OF THE INVENTION (1) Field of the Invention

This invention relates to a cabinet for displaying objects, consisting of top part fitted on an under part, wherein the top part is formed from a top face, a front side, a rear side, left and right sides and a bottom face and these together enclose a space in which objects can be displayed.

(2) Description of the Prior Art

Such cabinets are already known. Access to the interior of the cabinet is effected through a door for example, wherein the front side is hinged, as is described in EP 0 670 405. Furthermore the use of a front side formed as a sliding door has also been proposed.

If now a cabinet with a large width is required, the doors of hinged or sliding design require a correspondingly large region for swinging or sliding in the direct vicinity of the cabinet, which often cannot be made available in the display places of such cabinets. Division of the doors consisting of glass sheets into two wings or the use of two sliding parts cannot be contemplated in many cases for optical and other reasons (sealing).

A cabinet with a door hinged at the side is known from EP-A 0 670 405, in which the two hinges fitted one above the other on the cabinet housing are fitted slidably axially and perpendicular to the closing plane of the door. In the region of the lower hinge there is arranged a gas spring which presses the door against the door opening in the closed state of the cabinet and during opening of the door relieves the lower hinge of the weight of the door before the pivoting operation of the door when raising the door from the door opening, so that both hinges are moved uniformly out of the door opening.

Furthermore an apparatus for opening and closing folded wings is known. Thus a folded wing is described in DE-A 4 403 973 which is mounted rotatably on the underside and can be pivoted by a drive unit moved by auxiliary force. A rod of the drive unit pivotally fixed to a blind frame of the folded wing and the body of the drive unit is pivotally fixed to a bracket fixed to a side beam of the folded wing.

SUMMARY OF THE INVENTION

The object of the invention consists in so designing a cabinet of the kind initially referred to that it can have a large width without a particularly large region in the vicinity of the cabinet door being needed for opening the cabinet, wherein the movement of the front side in the context of the operation of opening and closing can be effected with no trouble by one person, in spite of the great weight of the door.

This object is met in that at least the front side is formed by a glass sheet, which is pivotally connected to the top face by suitable means, in that a gas spring is provided in the region of each of the left and right sides, acting on the middle region of the front side and attached to the bottom face in the region of the front side, wherein the force of each of the two gas springs corresponds approximately to half the weight of the front side, and in that the front side can be moved out of a closed position into an open position and vice versa by screw jacks each having an attachment point and an engagement point and which are driven by respective electric motors, which are both driven in synchronism through an electronic control device electrically connected thereto.

Since the height of such a cabinet does not as a rule exceed the height of the viewers and the top part often rests on an under part of whatever height, the swinging region of the front side formed as a door is not so large. The two gas springs have the prime purpose of taking the weight of the front side, so that relatively weak and thus small electric motors can be used to drive the screw jacks, so that the outer diameter of the screw jack housing is determined by the screw jack construction and not by the drive motor. The cabinet can be manufactured in very large widths with a correspondingly high weight of the front side, while the pivoting operation in opening and closing is carried out automatically by screw jacks, which are driven by synchronously running electric motors.

Advantageous developments of the invention appear from the dependent claims.

BRIEF DESCRIPTION OF THE DRAWINGS

The invention will be explained in more detail with reference to an embodiment whiffs shown in the drawings, in which.

DESCRIPTION OF THE PREFERRED EMBODIMENT

Figure 1:
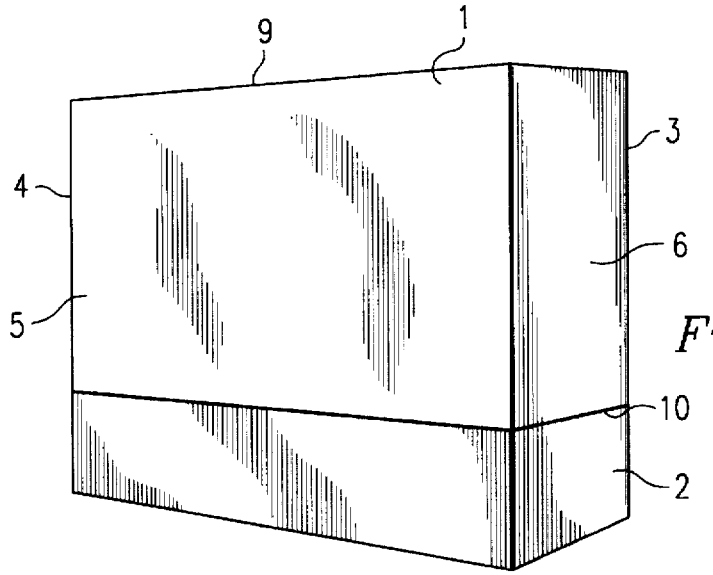
FIG. 1 perspective view of a cabinet.

A cabinet consists of a top part 1, which rests on an under part 2. The under part 2 standing on the floor 7 can be in the form of a low pedestal or a higher, open or closed sub-frame. The top part 1 consists of a top face 9, a front side 5, a rear side 3, left and right sides 4 and 6 respectively and a bottom face 10, which are suitably connected together at their end faces and together form an interior 24 for the objects to be displayed. At least the front side 5 is formed as a transparent glass sheet 25 and forms a door, which is attached to the top face 9 at its side adjacent the top face 9 at a pivot 8. The front side 5 formed as a door can be swung up until it is parallel to the top face 9.

The glass sheet 25 is held on all sides by a frame 11, to which it is firmly attached. The top part 1 consists of a framework which is formed from square steel hollow sections 26 with different cross-sections. Each of the sides 3, 4 and 6 with the exception of the front side 5 consists of a rectangular frame, whose top sections together with a top section 28 form the frame of the top face 9 and whose lower sections together with a bottom section 29 form the frame of the lower face 10. In between the left side 4 and the rear side 3 and between the right side 6 and the rear side 3 a common vertical section is present. The sides left 4 and right 6 are clad the outside of the framework, likewise the outside of the top face 9 (not shown). On the inside of the frame of the rear side 3, the left side 4 and the right side 5 respective linings 23 are fitted. On the side of the top part 1 facing the front side 5, namely on the front sections of the two sides 4 and 6 and the top section 28 and the bottom section 29 there is a surrounding sealing strip 20, on which the frame 11 bears in the closed state of the cabinet. The interior 24 within the top part 1 of the cabinet closed on all sides is closed off in this way, airtight relative to the surroundings even in the region of the movable front side 5.

The width of the square steel hollow section 26 in the region of the left 4 and right 6 side is so chosen that there is enough space to fit a gas spring 13 and a screw jack 14 between the outer casing, not shown, and the inner lining 23. This space is advantageously covered by a suitable covering, not shown, on the front side 5 when the top part 1 of the cabinet is closed. There is a shelf surface, not indicated, on the side of the bottom face 10 facing the top face 9. Below the outside of the top face 9 there is a space 22 for reception of a lighting unit. On the top section 28 of the frame of the top face 9 there is a screw jack with the pivot 8 of a hinge, whose wing 12 is fixedly connected to the frame 11 of the front side 5. Depending on the width of the front side 5 there are two or more hinges, which are covered in the closed state of the top part 1 by a cover strip 21 fixed on the top of the face 5.

A gas spring 13 is rotatably fixed by an attachment bracket 18 to the lower face 10 on the side facing the top face 9 in the region of each of the two left 4 and right 6 sides, in the vicinity of the front side 5. The other end of the gas spring 13 is rotatably connected to the frame 11 of the front side 5 by an attachment bracket 17, which is fitted at approximately half the height of the front side 5, wherein the gas spring 13 stands nearly vertical in the closed state of the front side 5. The force of each of the two gas springs corresponds approximately to half the weight of the pivoted front side 5.

Figure 4:
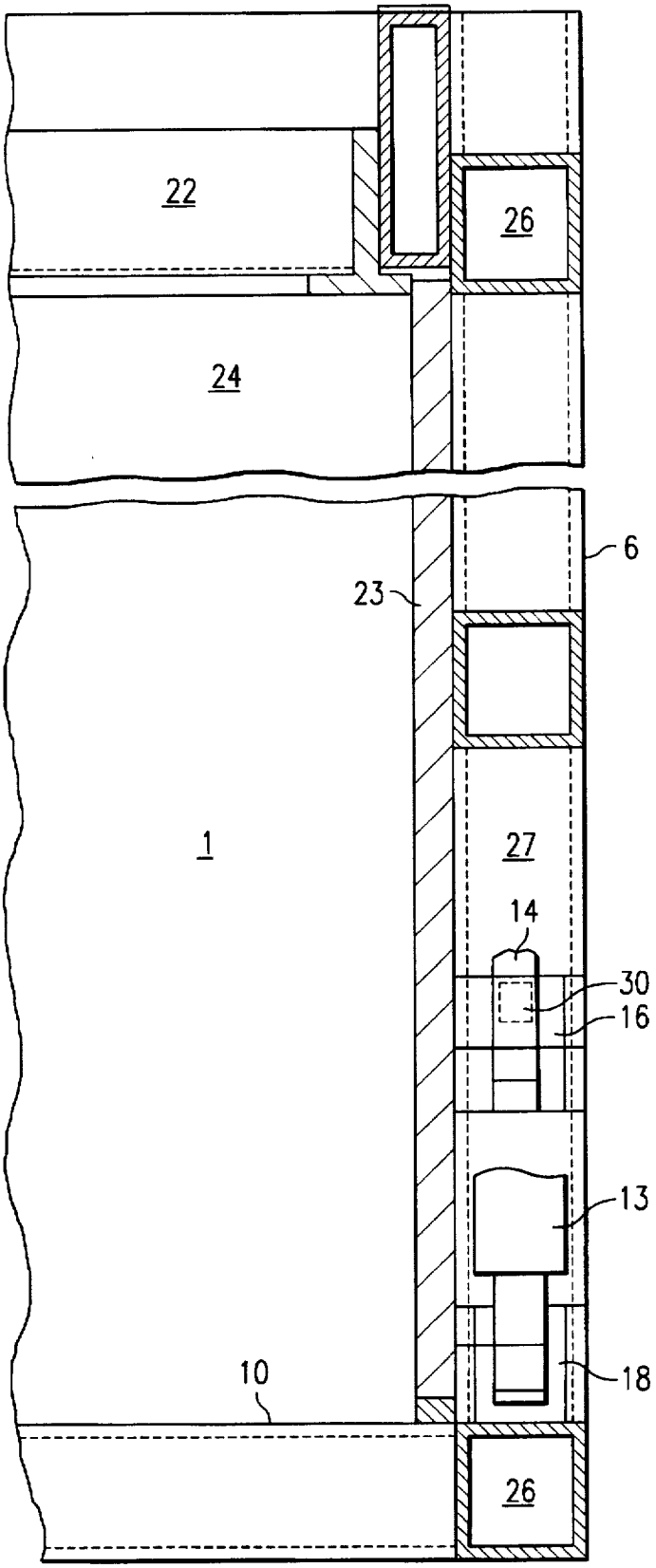
FIG. 4 is a vertical section through a cabinet in elevation from the front.

Only a little above the attachment bracket 17 of the gas spring 13 is rotatably attached the one end of the screw jack 14, with its other end rotatably connected to the rear side wall 3 by a further attachment bracket 16 on the side facing the front side 5, at some distance from the bottom face 10. This point of attachment is determined in accordance with the maximum extended length of the screw jack 14 and can also lie in the region of the bottom face 10. A screw jack 14 is arranged in the region of each of the left 4 and right 6 sides. The lines of action of the gas springs 13 and screw jacks 14 on each of the two sides lie in one plane as viewed in elevation from the front of the cabinet (see FIG. 4).

Figure 2:
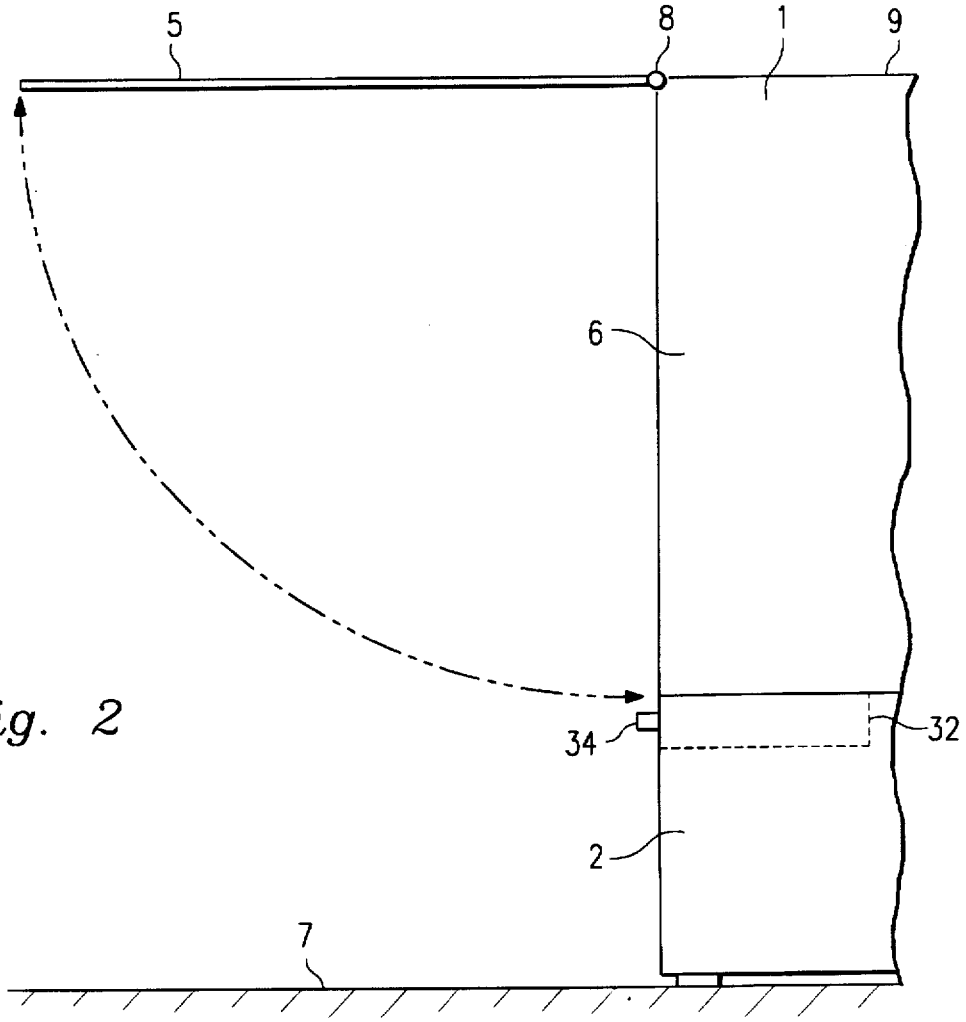
FIG. 2 is a side view of a cabinet with the front side opened.
Figure 3:
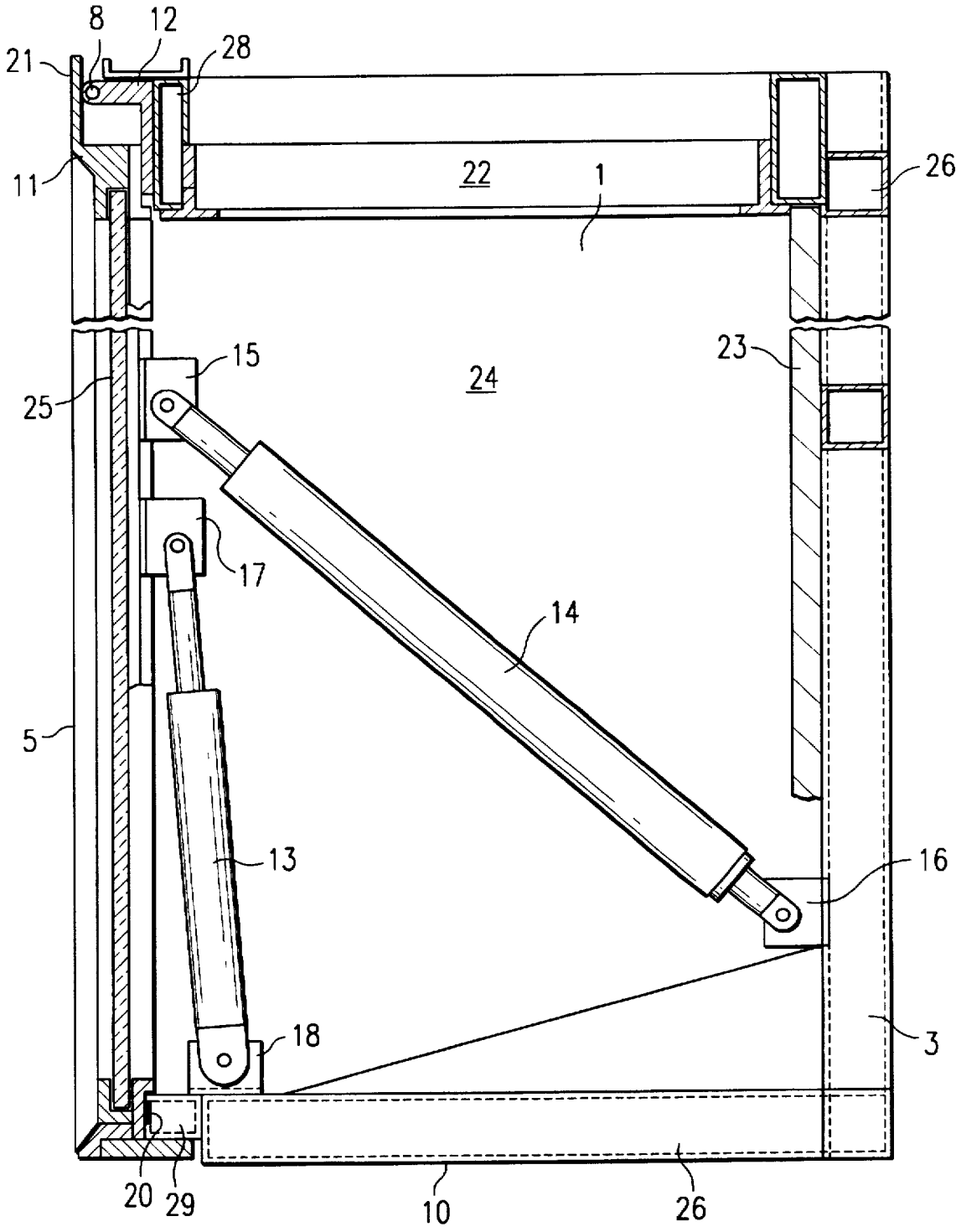
FIG. 3 is a vertical section through a cabinet in side view.

The screw jacks 14 are driven by electric motors, 30, fitted in their interiors and which are connected electrically to an electronic control device, 32, FIG. 2, fitted in the under part 2. Synchronous operation of the two screw jack motors is ensured by the electronic control device 32 and the current of each electric motor 30 is monitored. The electronic control device 32 interrupts the current on overstepping an adjustable threshold, where different thresholds can be provided for each of the two limit positions of a screw jack 14. Turning off the electric motors 30 is controlled in this way when the screw jacks 14 have reached one of the two limit positions. The force with which the front side is pressed against the surrounding sealing strip 20 in the closed state of the top part 1 can also be controlled in this way, if the screw jacks are so designed that they cannot attain their limit position in the retracted state, i.e. with the cabinet closed. The turning on and off of the screw jack movements can be effected by a switch 34 fitted on the outside of the under part 2 and connected electrically to the electronic control device 32 or through remote control in wire-free manner, through use of a suitable transmitter and receiver device, where the latter is fitted on the electronic control device 32. The electronic control device obtains its current supply from the mains or from a rechargeable battery.

The use of the invention is not limited to the embodiment but can be envisaged with cabinets of other constructions, wherein not only the front side 5 can be formed by a sheet of glass.

I claim:

1. A cabinet for displaying objects, consisting of a top part fitted on an under part, wherein the top part is formed from a top face, a front side, a rear side, left and right sides and a bottom face and these together enclose a space in which objects can be displayed, characterized in that at least the front side (5) is formed by a glass sheet, which is pivotally connected to the top face (9) by suitable means (8, 12), in that a gas spring (13) is provided in the region of each of the left (4) and right (6) sides, acting on the middle region of the front side (5) and attached to the bottom face (10) in the region of the front side (5), wherein the force of each of the two gas springs corresponds approximately to half the weight of the front side (5), and in that the front side (5) can be moved out of a closed position into an open position and vice versa by screw jacks (14) each having an attachment point and an engagement point and which are driven by respective electric motors, which are both driven in synchronism through an electronic control device electrically connected thereto.

2. The cabinet according to claim 1, characterized in that the screw jacks (14) are each arranged above the gas springs (13).

3. The cabinet according to claim 1 or 2, characterized in that the point of engagement of the screw jack (14) is arranged above a point of engagement of the gas spring (13) and in the vicinity of the same on the front side (5).

4. The cabinet according to claim 1, characterized in that the attachment point of the screw jack (14) lies in the region of the rear side (3) and the bottom face (10).

5. The cabinet according to claim 1, characterized in that the electronic control device can be controlled by a switch accessible from outside the cabinet.

6. The cabinet according to claim 1, characterized in that the electronic device control can be controlled wire-free.

7. The cabinet according to claim 1, characterized in that the electronic control device is powered by a mains.

8. The cabinet according to claim 1, characterized in that in each case the gas spring (13) and the screw jack (14) are fitted in a space (27) between the left (4) and right (6) side and a lining (23) is fitted in each case on the side facing the interior of the top part (1).

9. A cabinet according to claim 8, characterized in that the space (27) between the left and the right side is covered by the front side (5) in a closed state of the top part (1).

10. The cabinet according to claim 1, characterized in that the front side (5) is formed from the glass sheet which is surrounded on all sides by a frame (11).

11. The cabinet according to claim 10, characterized in that a plurality of hinges (8, 12) are fixedly attached to the top face (9) and are fitted on the frame (11) of the front side (5).

12. The cabinet according to claim 1, characterized in that the top part (1) of the cabinet, namely the top face (9), the bottom face (10), the rear side (3), the left (4) and the right (6) sides, is formed from a common steel, hollow section framework.

13. The cabinet according to claim 1, characterized in that the electronic control device is powered by a rechargeable battery.

* * * * *

UNITED STATES PATENT AND TRADEMARK OFFICE

CERTIFICATE OF CORRECTION

PATENT NO. : 5,755,496

DATED : May 26, 1998

INVENTOR(s) : Thomas Hahn

It is certified that error appears in the above-identified patent and that said Letters Patent is hereby corrected as shown below:

Col. 2, line 21, "whiffs" should be --which is--.

Col. 3, line 60, "device obtains" should be --device 32 obtains--.

Signed and Sealed this

Sixteenth Day of February, 1999

*Attest:*

*Attesting Officer*

*Acting Commissioner of Patents and Trademarks*